United States Patent [19]

Ganzel

[11] 4,070,989

[45] Jan. 31, 1978

[54] LARGE ANIMAL CONVALESCENT UNIT

[76] Inventor: David K. Ganzel, 1112 N. Hester St., Stillwater, Okla. 74074

[21] Appl. No.: 714,789

[22] Filed: Aug. 16, 1976

[51] Int. Cl.[2] ..... A61D 3/00

[52] U.S. Cl. ..... 119/27; 119/102

[58] Field of Search ..... 119/27, 29, 158, 102, 119/96; 5/370, 371, 375

[56] References Cited

U.S. PATENT DOCUMENTS

| | | | |
|---|---|---|---|
| 1,943,888 | 1/1934 | Ewald | 5/370 |
| 3,802,004 | 4/1974 | Whitney | 5/371 |
| 3,835,815 | 9/1974 | Matthews | 119/158 |

*Primary Examiner*—Hugh R. Chamblee

*Attorney, Agent, or Firm*—Head, Johnson & Chafin

[57] ABSTRACT

A convalescent recovery stall for large animals comprises a rectangular frame of length and width greater than the corresponding dimensions of the animal, with means for inserting wall sections into said frame, so as to provide a rectangular box surrounding said animal, to a selected height. There is at least one rectangular, closed, flexible-walled water tank which will fit snuggly within the walls of the box. There is at least one reentrant tube of flexible material sealed into the top surface of the tank. Altogether there will be four such tubes one for each of the four legs. The contour of the tube is such as to fit a leg of the animal. The vertical height of the tank is greater than the length of the legs of the animal so that when the tank is filled with water under pressure, the water pressing on the surfaces of the legs, chest and abdomen of the animal, will support its weight. There can be one such tank with four reentrant tubes, one for each of the four legs, or two, or four tanks depending on the size of the animal.

8 Claims, 14 Drawing Figures

LARGE ANIMAL CONVALESCENT UNIT

BACKGROUND OF THE INVENTION

This invention is in the field of animal husbandry. More particularly it concerns apparatus for supporting an injured animal in such a way that there is no weight on the legs, and the animal has some freedom of movement of the legs.

In the prior art, when a large, four-legged animal, such as a horse, or cattle, is injured, and one leg cannot support its proportionate share of the weight of the animal, the usual method of supporting the weight of the animal while the bones in the leg knit, is by means of a wide strap under the abdomen and chest of the animal which is supported by a framework, so that the animal's feet are off the floor. Unfortunately, because of the length of time required for healing of the injury, and the poor facilities for handling incapacitated animals, there is very seldom full recovery when conventional methods are used.

In the conventional methods, the animal is placed in a rest stall where it lies on a bed of straw or some other form of bedding. In other cases, the practice is to sling the animal in a support harness. Both of these methods have objectionable features in that an animal laying on the straw floor for long periods such as in excess of 1 week may develop very severe bed sores. Also those animals which are supported by slings are prone to pneumonia and choking, due to the pressure of the sling against the chest of the animal.

SUMMARY OF THE INVENTION

It is the primary object of the invention to provide a stall rest type of apparatus for an injured large animal, whereby its weight can be supported by a "water bed" composed of one or more flexible tanks of water surrounding the legs, chest and abdomen of the animal. By this means, a low unit pressure applied to a large surface of the animal can support its great weight, without causing sufficient pressure at any point to form skin sores, or injure the internal parts of the animal.

This and other objects are realized and the limitations of the prior art are overcome in this invention by floating the animal on a water-bed-like unit, which enables the animal's body weight to be supported by the water pressure, and avoiding high pressure on relatively small zones of support, which result in bed sores, while enabling the animal to have adequate freedom to maintain his respiratory functions and avoid pneumonia complications.

The unit consists of a stall frame that can easily be broken down and moved. It comprises a rectangular frame with removable walls forming a rectangular box. Four replaceable water tanks that function as water beds are provided, which together fit snuggly within the walls of the box, while having reentrant openings or tubes which can be slipped over the legs of the animal. The height of the tank is greater than the length of the legs of the animal, so that there is upward pressure against the under surface of the chest, abdomen and lower sides of the animal.

A single large tank could be used with four reentrant tubes, or two tanks, each with two reentrant tubes, one for each of two legs, or there can be four separate rectangular tanks, one adapted to fit over each leg. When the tanks are filled with water and are retained within the walls of the box, the water presses on the outside of the reentrant tubes and presses over the entire surface of the legs of the animal, and by the top surface of the tank, it presses on the undersurface of the animal. Since the tanks are restrained on all surfaces, raising the water pressure in the tanks can supply a high enough unit pressure on the surface of the animal to support its entire weight, while having a relatively nominal unit pressure at any point of the skin of the animal.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 2:
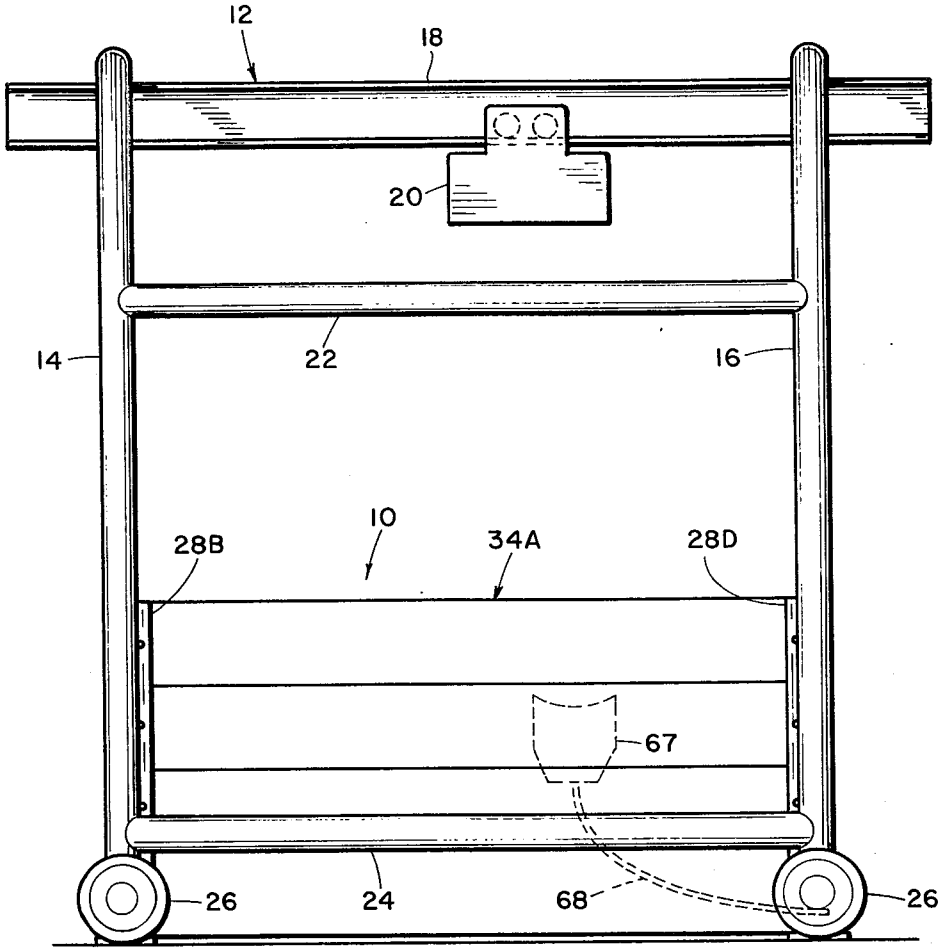
FIGS. 1, 2 and 3 provide external elevation views of one embodiment of the apparatus of this invention.
Figure 1:
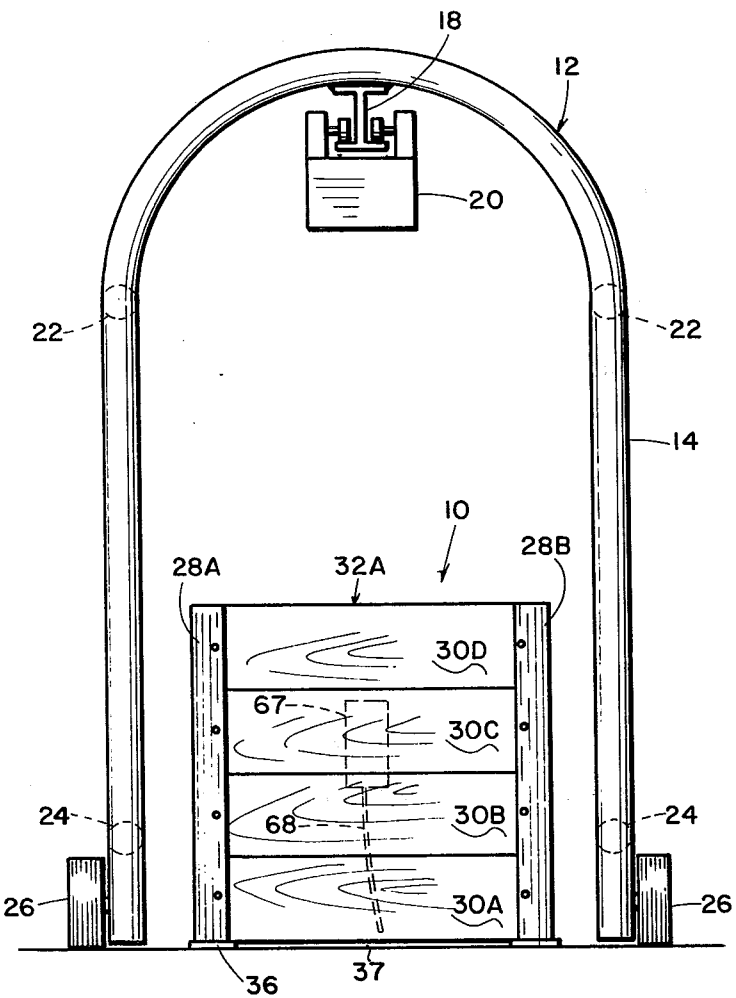
Figure 3:
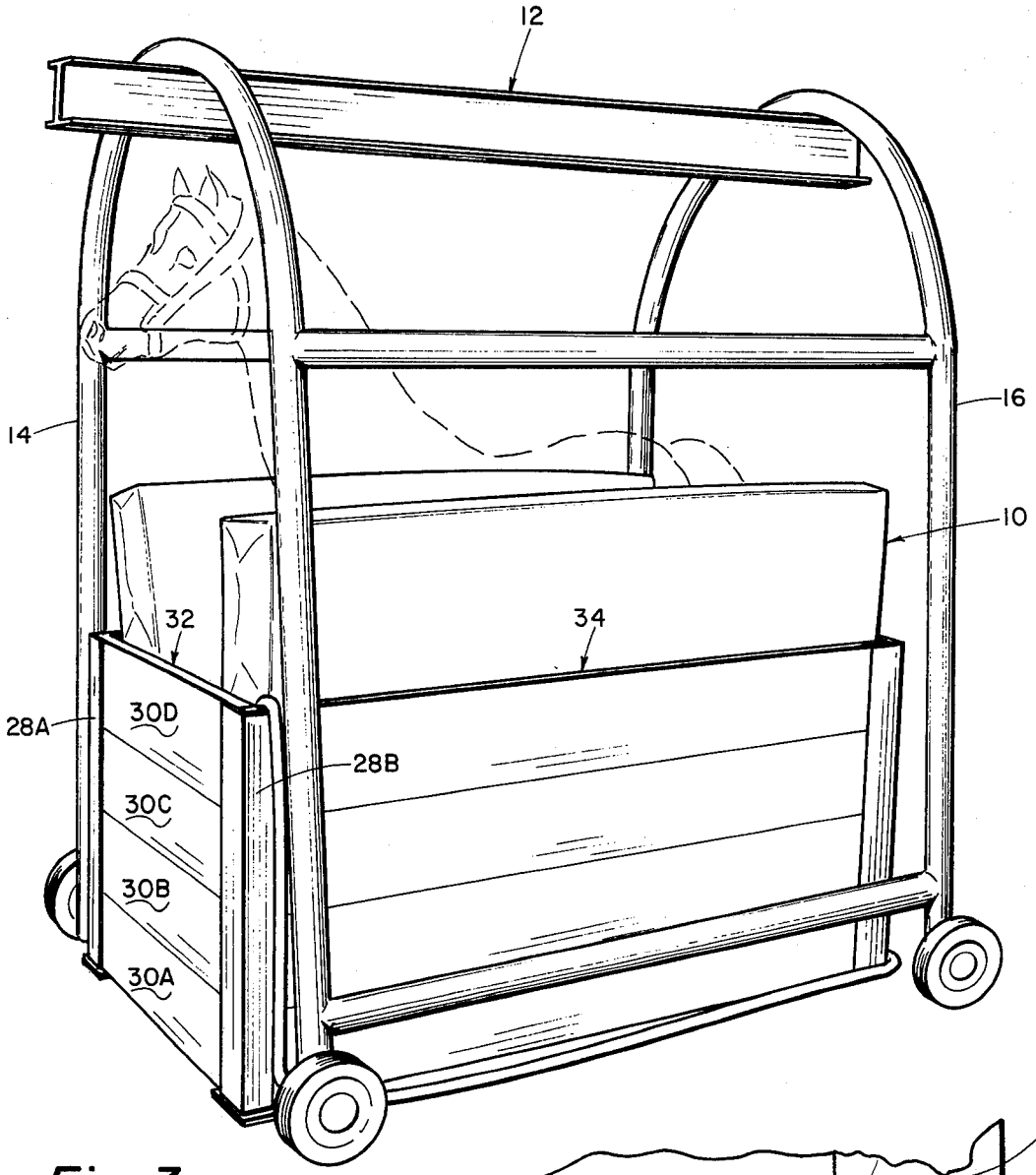

Referring now to the drawings and in particular to FIGS. 1, 2 and 3, there is shown one embodiment of the apparatus of this invention.

Indicated generally by numeral 10 is a box or stall, and by the numeral 12, is a framework or movable structure, and hoist, which can be used for installing an injured animal into the stall of this invention.

The stall comprises a rectangular box 10 having a base 37 with supports 36 in each of the four corners. These supports 36 are attached to the base 37 and support the corner posts 28 which are detailed in FIG. 4. These comprise a pair of U-shaped channels, which are at right angles, and into which can be slipped a plurality of boards, such as 30A, 30B, 30C, 30D in a front wall 32A for example.

Figure 4:
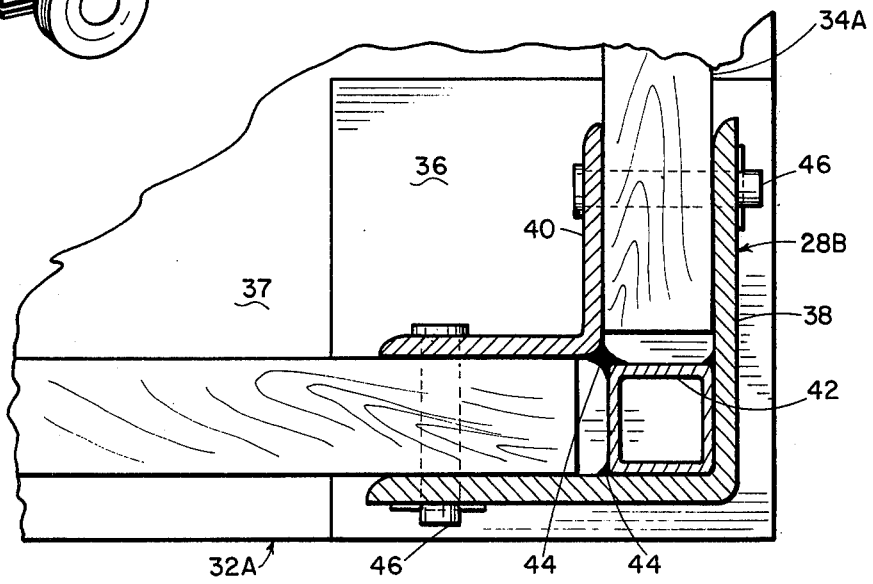
FIG. 4 shows a detail of the frame and the sidewalls.
Figure 5:
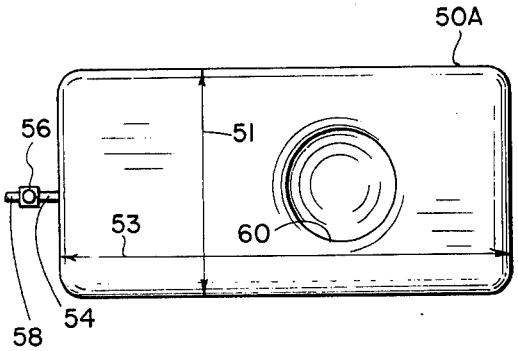
FIGS. 5 to 10 show various views of the water tanks of one embodiment of this invention.

Referring to FIG. 4, the corner posts can be constructed in a number of ways, but one satisfactory way is to use steel angles, such as an internal angle 40, and external angle 38, of appropriately larger size. These two angles are welded together by the use of a tubular section 42 of suitable size, that is attached by welds 44, for example, so that the two angles are supported together forming U-shaped channels at right angles to each other. The channels on adjacent corner posts are in the same plane. Boards such as indicated by 32A and 34A can be slipped into the U-channels. Appropriate bolts 46 are inserted through the arms of the U with appropriate fasteners, which may be nuts, pins or other means. Since there will be substantial lateral pressure internally on the walls of the box, the corner posts and the walls themselves must be sufficiently rigid and strong to support the lateral pressure. The walls themselves may be made from metal plates or boards of two inches thick wood, for example, which are locked into the channels by means of the bolts 46.

The plates 36 to which the corner posts are attached as by welding, are supported on a floor plate 37, which can be wood or metal as desired, to keep the corner posts from spreading under the internal pressure that will be developed against the walls.

The structure 14 is used to support and transport an injured animal, which would be supported by a band or strap which is attached to a hoist 20, which runs on a track 18 for example, which are reinforced by means of horizontal pipes 22 and 24, and so on. There is nothing critical about the type of structure. Wheels such as 26 will be provided for moving the frame, so that it can be positioned over a box such as 10.

Figure 11:
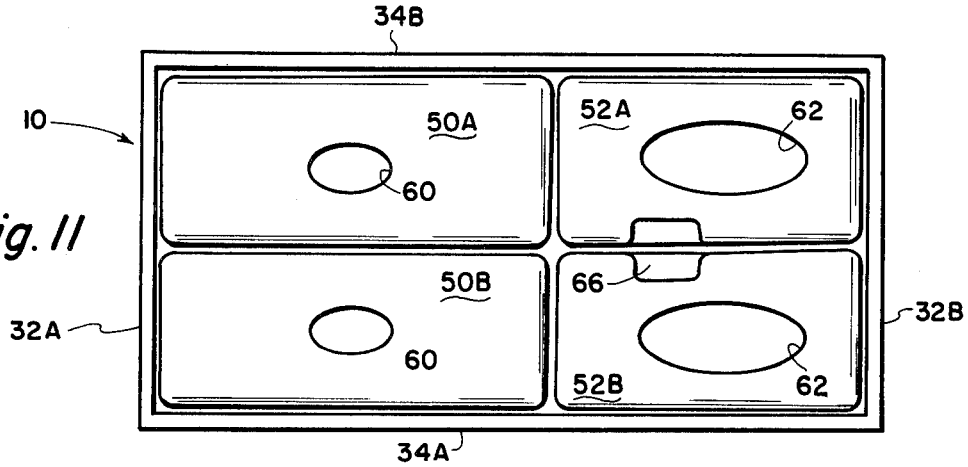
FIGS. 11 to 14 show alternate arrangements of water containers that can be used.

Referring briefly to FIG. 11, there is shown in plan view the four walls 32A, 32B which are the front and back end walls of the box, and 34A and 34B which are the sidewalls of the box 10. Inside the box are shown four rectangular water tanks which are closed containers made of a pliant, strong, flexible, impervious material. There are reentrant tubes, such as 60 or 62 which are sealed into the top surfaces of the tanks 50A, 50B, 52A and 52B respectively. Two of the openings 60 would be of a contour to fit, for example, the fore legs of the animal, while the reentrant tubes 62 would be of a contour to fit the hind legs of the animal. They would be spaced apart a proper distance so as to fit the structure of the animal.

Further detail of the tanks is shown in FIGS. 5 to 10 where tank 50A is adapted to fit a fore leg and tank 52A is adapted to fit a hind leg.

Figure 8:
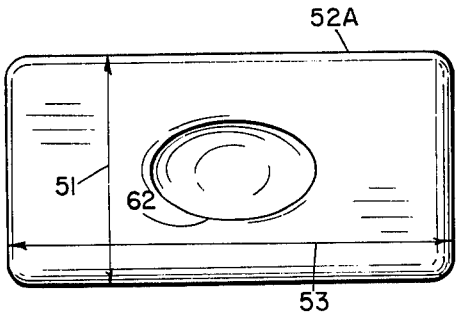
Figure 6:
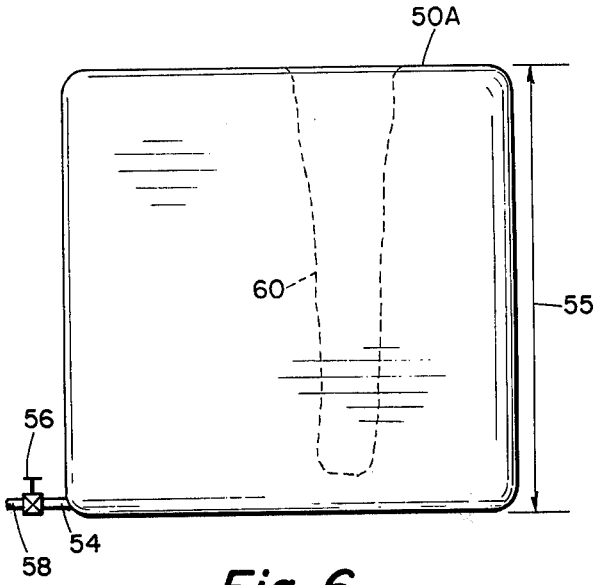
Figure 9:
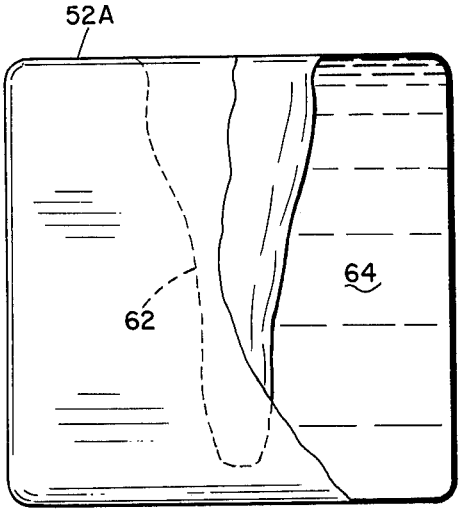
Figure 7:
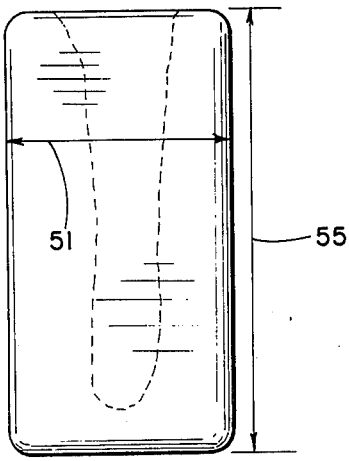
Figure 10:
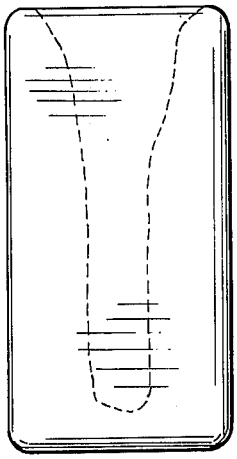

Each of the tanks is fitted with a pipe 54 and valve 56 to which a supply pipe or hose 58 can be attached, for filling and emptying the tank with water 64, such as shown in partial section of FIG. 8.

The vertical dimension 55 of the tank is greater than the length of the animal's legs so that the animal's hoofs are held above the bottom of the tank at all times by the hydrostatic pressure inside the tank, pressing upward against the undersurface of the animal. The length 53 and width 51 are such that the four tanks will fit into the box 10.

Since there is a large area of the tank in contact with the animal's skin, the unit pressure against the skin can be quite nominal, and therefore will prevent injury to the skin or to the internal organs of the animal.

Shown in FIGS. 1 and 2, is a cup which can be made out of metal or plastic identified to the numeral 67 which is connected to a tube 68 which vents outside of the box. This would be positioned within an open space 66 in the walls of the two tanks 52A and 52B in a proper place to collect the urine voided by the animal. This is necessary since the animal would be in this stall for a substantial period of time.

While I have shown the "water bed" comprising four separate tanks made of the flexible plastic material, there could be two tanks each adapted to support two legs of the animal. These could be the two front legs and the two hind legs.

Alternately, the two legs could be the fore and hind side legs so that whichever way is most convenient for assemblying and applying the water tanks can best be followed. Thus, the tanks 50A and 50B could be combined and 52A and 52B combined. Also 50A and 52A could be combined, and so on.

Figure 12:
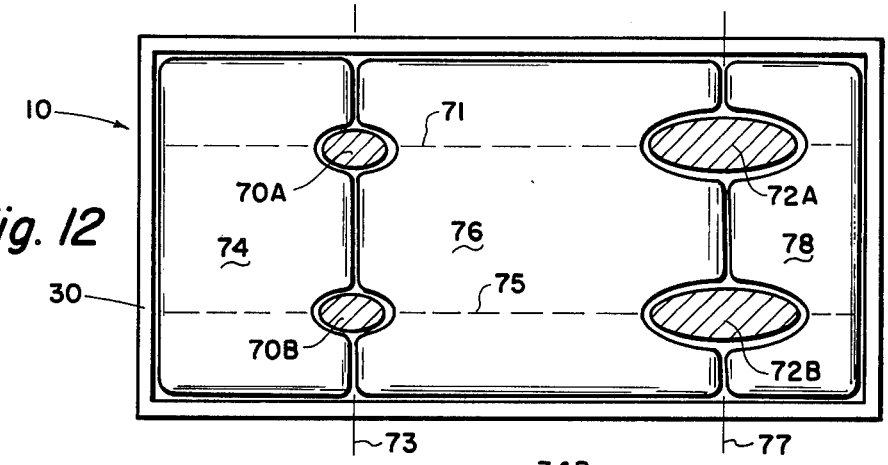

Illustrated in FIG. 12 is another way of designing the water tanks. There are three tanks 74, 76 and 78 which divide the longitudinal length of the box 10 into three contiguous portions. The dividing lines correspond to the vertical planes through the center lines of the pairs of animal's legs. The matching walls of the tanks would have concavities such as 70A, 70B, 72A, 72B, etc. so as to snuggly fit around the legs of the animal. With this type of construction, the empty tanks would be positioned while the animal is suspended a few inches off the base of the box.

By removing some or all of the boards from the walls the animal then can be moved between the corner posts 28A, 28B. When it is suspended over the base 37, the water tanks, having been at least partially emptied of water, are fitted over (or about) the legs of the animal, like stockings, while a little water is in place to support the tank. The sideboards are then positioned in the slots of the corner posts. After the sidewalls are in place, the tanks can then be filled with water until the top surface of the tank presses upward on the under surface of the animal. Then by increasing the pressure in the tanks, the weight of the animal can be supported. The sling, by means of which, the animal had been supported can then be loosened and removed, leaving the animal supported in the "water bed" with freedom to move its legs at will.

The types of tanks illustrated in FIG. 12 would be assembled in the same wax, although they would be easier to assemble since they do not have a tubing which must be slid over the legs of the animal. The partial walls would be put in position in the box and the tanks fitted in between the box walls and the legs of the animal. Water is put in the tanks to hold them in place, and the next layer of wall is put in place. The tanks are filled with more liquid and so on, and the tanks themselves are adjusted and moved around so as to properly fit the walls of the box and the legs of the animal.

In FIG. 12 are shown two spaced transverse dashed lines, 73 and 77. These represent vertical planes through the centerlines of the fore leg pair and the hind leg pair respectively. The first tank 74 extends from the front wall 32A to the plane 73. The second tank 76 extends between the two planes 73 and 77. The third tank 78 extends between the rear wall 32B and the plane 77. The tanks 74 and 76 are contiguous along the plane 73, while the tanks 76 and 78 are contiguous along the plane 77.

It is possible, in accordance with the dashed lines 71 and 75, to make the vertical dividing planes 71, 75 pass through the fore and hind legs on one side, or the other side. That is, the space can be divided into three parts by the vertical planes 71, 75.

Figure 13:
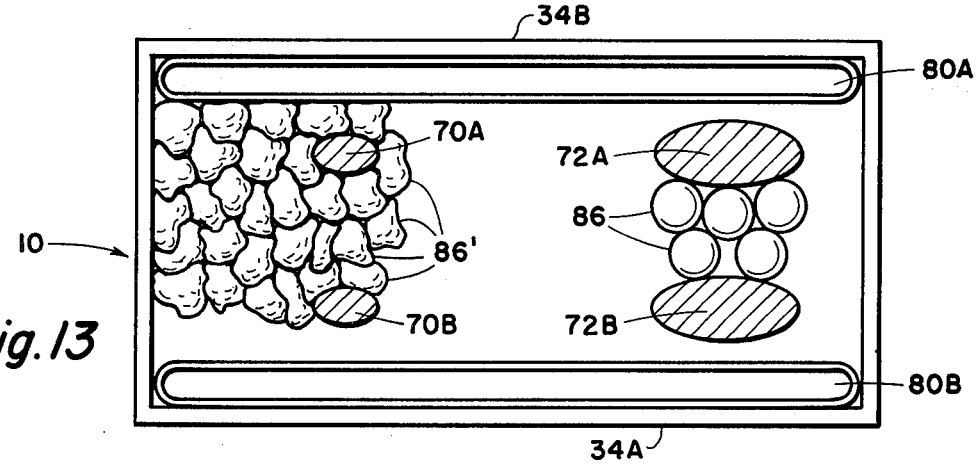
Figure 14:
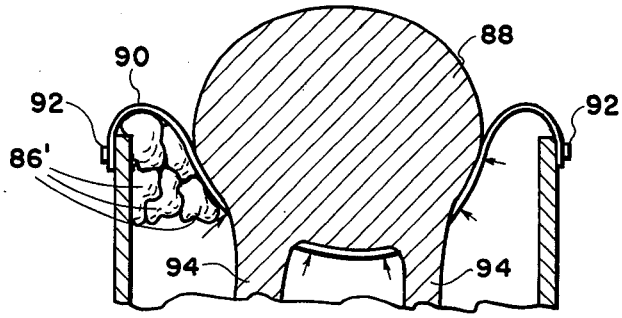

FIG. 13 illustrates another embodiment in which one or more expandable containers, tanks or pillows 80A, 80B, etc. can be positioned inside the box, either on the sides or on the bottom, for example. The remaining space between the legs and the walls are filled with a plurality of thin-walled deformable bags 86 of water. While these are nominally spherical, 86, they will fit together 86 to eliminate substantially all void space between the bags as they are piled in the box, up to the lower surface of the body of the animal. Then when water is pumped into the expandable container, it will press on the bags, and push them upwardly in contact with the body. The unit pressure in the container will be communicated to the animals body, supporting its weight.

By filling the volume with separate small bags 86, it is possible to adjust the apparatus to the size of any animal placed in the stall.

It may be desirable, in the case of the embodiment of FIG. 13 to stretch across the top of the box 10 a sheet 90 of pliant material that has openings cut in the positions of the four legs 94. This sheet would be slipped under the animal and attached loosely to the outside surfaces of the walls by means 90. The sheet would contain the water bags at the surface, in the annular space between the body and the box, and provide a larger area (and lower unit pressure to support the animal).

In another embodiment it would be possible to cut the box across the plane 14—14 and support only the front half, or back half of the animal. By placing wheels on the "half box", the animal could be made mobile, while keeping half of the body immobile.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A large quadruped animal convalescent recovery stall, comprising:

a. an upright, opened top box of dimensions to receive the animal and of height at least greater than the legs of the animal;

b. closed, expandable flexible-walled, water tank means, having four reentrant tubes sealed into the top surface, the contour of each said tube being designed to fit one leg of said animal, said tank means fitting within said walls of said box, the height of the water tank means, when filled with water being greater than the length of the legs of the animal; and c. means to fill said tank means with water after the animal's legs are positioned in said tubes whereby the water pressure in said tank means pressing on the surfaces of the legs and on the lower portions of the body of the animal supports the weight of the animal.

2. The recovery stall as in claim 1 in which said tank means is in the form of four substantially rectangular tanks fitted into said box, each with one reentrant tube in the top.

3. The recovery stall as in claim 1 including a portable structure and hoist which can be positioned over said frame, providing means of supporting said animal off the floor while said tank means is positioned about the legs of said animal.

4. The recovery stall as in claim 1 in which said box comprises:

a frame having means to receive wall section, the frame comprising:

a. a rectangular base;

b. four corner posts at the corners of said base;

c. each post having U-shaped vertical slots at right angles, the U slots on adjacent corners being in the same plane;

whereby boards can be inserted into said U slots to provide walls for said box.

5. A large animal convalescent recovery stall, comprising:

a. a rectangular frame, of length and width greater than the corresponding dimensions of said large animal;

b. means for inserting wall sections into said frame so as to provide a box surrounding said animal, to a selected height;

c. three substantially rectangular tanks arranged along a first dimension in said box, each tank closed and flexible-walled, the vertical height of said tanks greater than the length of the legs of said animal;

d. each tank of width equal to the second dimension of said box, e. the first tank of length from a first wall of said box to the vertical plane parallel to said first wall passing through the center lines of the first pair of legs of said animal;

f. the second tank of length between the two vertical planes parallel to said first wall passing through the two pairs of legs of said animal;

g. the third tank of length from the second wall of said box parallel to said first wall to the vertical plane through the center lines of the second pair of legs; and h. means to fill said tanks with water after said tanks are positioned around the legs of said animal and said walls are in place in said frame;

whereby the water pressure in said tanks pressing on the surfaces of the legs, chest and abdomen of said animal will support the weight of said animal.

6. The recovery stall as in claim 5 in which said first dimension is the length of said box, said second dimension is the width of said box, said first wall is the front end wall of said box, and said second wall is the back end wall of said box.

7. The recovery stall as in claim 5 in which said first dimension is the width of said box, said second dimension is the length of said box, said first wall is a first side wall of said box, and said second wall is the second side wall of said box.

8. A large animal convalescent stall comprising;

a. a rectangular box of length and width greater than the corresponding dimensions of said animal, and of selected height;

b. means for temporarily opening at least one wall of said box to permit entry of said animal thereinto;

c. at least one expandable flexible walled container insertable into said box;

d. a plurality of small thin-walled, closed, flexible, containers or balloons, placed in said box between the legs of said animal and the sides of said box, the number of balloons sufficient to fill the space in said box up to the body of said animal; and e. means to fill said container with water under a selected pressure;

whereby as said pressure increases said container will expand and cause said balloons to be compressed and to fit tightly together;

and whereby the top surface of said balloons will rise and press on the body and support the weight of said animal.

* * * * *